US011065780B2

(12) United States Patent
Turcot

(10) Patent No.: US 11,065,780 B2
(45) Date of Patent: Jul. 20, 2021

(54) ADJUSTING MECHANISM FOR A CUTTING TOOL

(71) Applicant: NAP ASSET HOLDINGS LTD., Wilmington, DE (US)

(72) Inventor: Philippe Turcot, Marieville (CA)

(73) Assignee: NAP ASSET HOLDINGS LTD., Wilmington, DE (US)

( * ) Notice: Subject to any disclaimer, the term of this patent is extended or adjusted under 35 U.S.C. 154(b) by 259 days.

(21) Appl. No.: 16/042,368

(22) Filed: Jul. 23, 2018

(65) Prior Publication Data

US 2020/0023545 A1 Jan. 23, 2020

(51) Int. Cl.

| | |
|---|---|
| ***B27G 13/00*** | (2006.01) |
| ***B27G 13/14*** | (2006.01) |
| ***B27F 1/04*** | (2006.01) |

(52) U.S. Cl.

CPC ..... *B27G 13/14* (2013.01); *B27F 1/04* (2013.01); *B27G 13/002* (2013.01)

(58) Field of Classification Search

CPC ..... B23B 2235/21; B23B 47/32; B27F 1/00; B27F 1/02; B27F 1/04; B27F 1/06; B27F 1/08; B27F 1/10; B27F 1/12; B27F 5/00; B27F 5/02; B27G 5/00; B27G 5/02; B27G 13/00; B27G 13/02; B27G 13/08; B27G 13/10; B27G 13/12; B27G 13/14; B27G 13/005; B27G 13/007

USPC ..... 83/665–666; 409/232

See application file for complete search history.

(56) References Cited

U.S. PATENT DOCUMENTS

| | | | | |
|---|---|---|---|---|
| 161,287 A * | 3/1875 | Slayton | ..... | B27G 13/14 144/222 |
| 1,688,913 A * | 10/1928 | Ahrendt | ..... | B27G 13/14 144/230 |
| 2,560,174 A * | 7/1951 | Jorsch | ..... | B27G 13/10 144/231 |
| 3,739,442 A | 6/1973 | Lovendahl | | |

(Continued)

FOREIGN PATENT DOCUMENTS

| | | | | |
|---|---|---|---|---|
| CA | 2491977 A1 * | 7/2006 | ..... | B27G 13/10 |
| FR | 2745222 A1 * | 8/1997 | ..... | B23C 5/2444 |
| GB | 297334 A * | 2/1929 | ..... | B27G 13/14 |

*Primary Examiner* — Adam J Eiseman
*Assistant Examiner* — Dylan Schommer
(74) *Attorney, Agent, or Firm* — Norton Rose Fulbright Canada LLP

(57) ABSTRACT

An adjusting mechanism for a cutting tool having knife holders circumferentially interspaced and having a back surface facing a circumferential direction and a seat surface facing a radial direction. The mechanism includes a support member having fixation points securable to the cutting tool. A deformable member is sandwiched between the cutting tool and the support member. The deformable member defines an adjustable lateral reference surface facing an axial direction to be in abutment with the knife inserts. An adjustment member is mounted on one of the support member and the deformable member between the fixation points of the support member. The adjustment member is operable to exert a force on the deformable member to locally deform the deformable member from an undeformed state to a deformed state. An axial distance between the support member and the deformable member is greater in the deformed state than in the undeformed state.

14 Claims, 3 Drawing Sheets

(56) References Cited

U.S. PATENT DOCUMENTS

| | | | | |
|---|---|---|---|---|
| 4,326,361 | A * | 4/1982 | McGill | B23D 61/10<br>451/342 |
| 4,339,893 | A * | 7/1982 | Fournier | B24D 5/16<br>409/234 |
| 2003/0033919 | A1 | 2/2003 | Lin et al. | |

* cited by examiner

ADJUSTING MECHANISM FOR A CUTTING TOOL

TECHNICAL FIELD

The application relates generally to cutting tools and, more particularly, to systems and methods used for correcting radial and/or lateral run-outs of such cutting tools.

BACKGROUND OF THE ART

Hard wood floors typically include a plurality of planks secured to one another using a tongue-and-groove arrangement. Machines are used to machine a tongue and a groove respectively on opposed sides of the planks. Such machines include a shaft on which a cutting tool is secured. The cutting tool includes a plurality of knife inserts distributed around its circumference.

Once the tongues and grooves are machined, there is usually no more operation carried along the profiled sides of the plank (i.e. there is no sanding of the tongues and grooves). To ensure a precise machining, the knife inserts are partially abraded away using a stone model that corresponds to a shape of either one of the tongue or the groove. The stone model is made of a material harder than a material of the knife inserts. The cutting tool is rotated and the stone is slowly brought in proximity to the knife inserts. Portions of knife inserts that are outside manufacturing tolerances will be grinded away by the stone.

To increase productivity, it is desirable to feed the planks to the machine as fast as possible. Furthermore, the less frequent the knife inserts have to be sharpen or replace the better. Therefore, it might be advantageous to use knife inserts made of wear resistant material, such as diamond and/or carbide, which are very hard materials. Using such materials might allow to decrease the sharpening frequency of the knife inserts and increase productivity. However, such hard materials may not be profiled using a stone model because the stone model is not sufficiently hard to abrade away portions of the knife inserts made of carbide/diamonds.

Adjusting the knife inserts to accurately machine the tongues and the grooves is complicated because rotation of the shaft of the machine may induce a radial run-out. The radial run-out corresponds to variations of a radius of the shaft when in rotation. It is typically measurable by disposing a gauge or probe sensor in contact with a cylindrical surface of the shaft and by rotating the shaft relative to the gauge. The radial run-out corresponds to a variation between minimum and maximum values measured by the gauge. The shaft may also present a lateral, or axial, run-out. The lateral run-out appears when the radial run-out of the shaft varies along an axis of the shaft. In other words, the lateral run-out will be present if the radial run-out at a first axial position on the shaft is different than that at a second axial position of the shaft relative to its axis. The lateral run-out induces the knife inserts of the cutting tool to go up and down when the cutting tool and the shaft are driven in rotation. When manufacturing a groove, the radial run-out causes a depth of the groove to vary along the length of the plank whereas the lateral run-out induces up and down waves in the groove along the length of the plank.

Existing systems used for correcting the radial and lateral run-outs have drawbacks. There is therefore still a need for improvements.

SUMMARY

In one aspect, there is provided an adjusting mechanism for a cutting tool rotatable about an axis, the cutting tool having knife holders circumferentially interspaced around a circumference thereof, the knife holders having a back surface facing a circumferential direction relative to the axis and a seat surface facing a radial direction relative to the axis, the adjusting mechanism comprising: a support member configured for circumferentially spanning at least two of the knife holders, the support member having fixation points securable to the cutting tool; a deformable member configured for being sandwiched axially between the cutting tool and the support member, the deformable member defining an adjustable lateral reference surface facing an axial direction relative to the axis and configured to be in abutment with the knife inserts of the cutting tool; and an adjustment member mounted on one of the support member and the deformable member at a location between the fixation points of the support member, the adjustment member being operable to exert a force on the deformable member to locally deform the deformable member from an undeformed state to a deformed state, an axial distance between the support member and the deformable member at the location being greater in the deformed state than in the undeformed state, an axial position of the adjustable lateral reference surface at the location varying from the undeformed state to the deformed state.

In another aspect, there is provided a cutting tool rotatable about and axis, the cutting tool comprising: knife holders circumferentially interspaced around a circumference thereof, the knife holders having back surfaces facing a circumferential direction relative to the axis and seat surface facing a radial direction relative to the axis, the back surfaces and the seat surfaces configured to be in abutment against knife inserts; an adjusting mechanism including a support member circumferentially spanning at least two of the knife holders and secured to the knife holders at fixation points, a deformable member sandwiched between the cutting tool and the support member, the deformable member defining an adjustable lateral reference surface facing an axial direction relative to the axis and being in abutment with the knife inserts, an adjustment member mounted on one of the support member and the deformable member at a location between the fixation points of the support member, the adjustment member being operable to exert a force on the deformable member to locally deform the deformable member from an undeformed state to a deformed state, an axial distance between the support member and the deformable member at the location being greater in the deformed state than in the undeformed state, an axial position of the adjustable lateral reference surface at the location varying from the undeformed state to the deformed state.

In yet another aspect, there is provided a method for adjusting knife inserts on a cutting tool rotatable about an axis, comprising: abutting the knife inserts against back surfaces and seat surfaces of knife holders of the cutting tool; abutting the knife inserts against an adjustable lateral reference surface of a deformable member of an adjusting mechanism; and deforming the deformable member at least at a location between fixation points of the support member.

DESCRIPTION OF THE DRAWINGS

Reference is now made to the accompanying figures in which.

DETAILED DESCRIPTION

Figure 1:
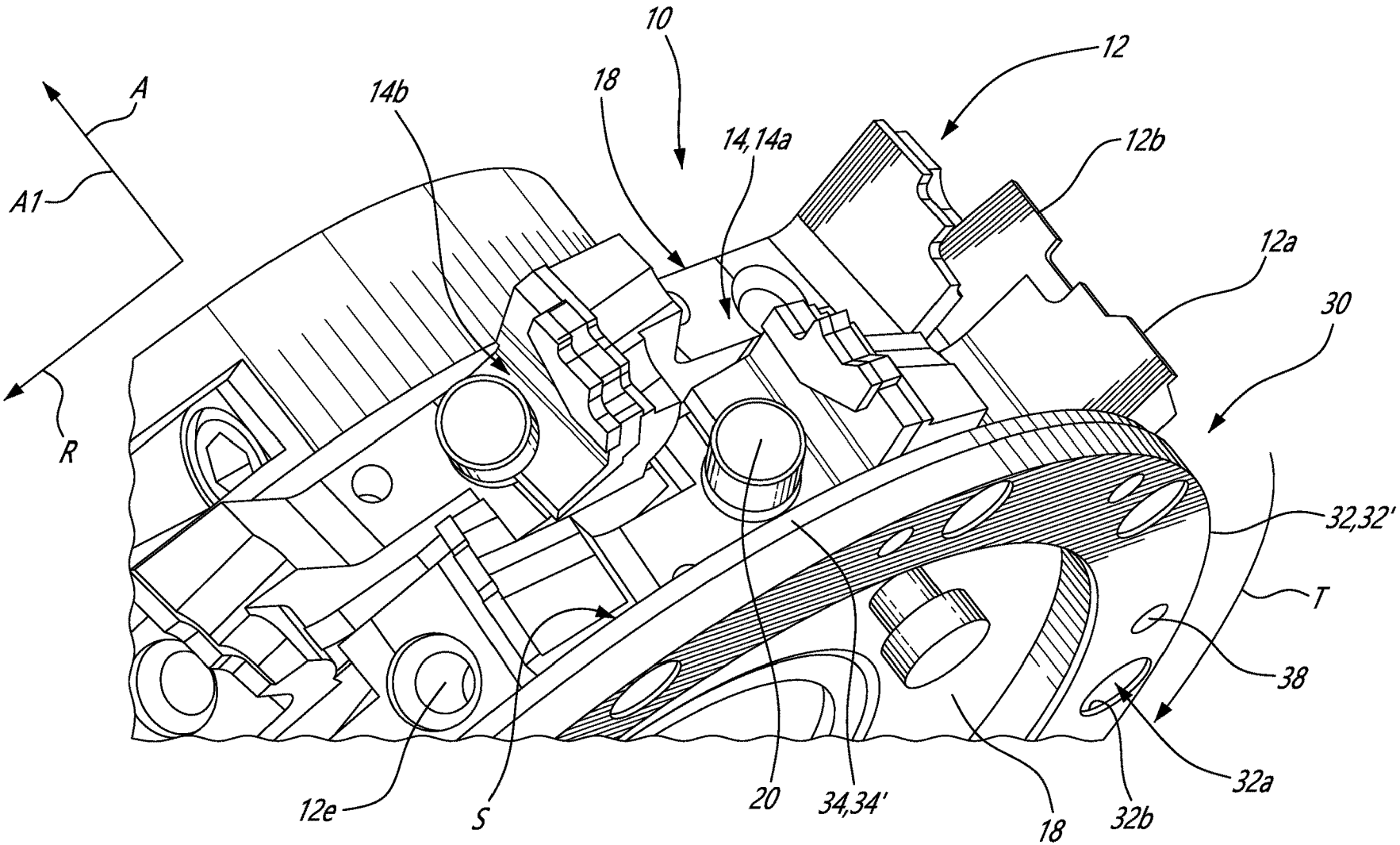
FIG. 1 is a schematic partial tridimensional view of a cutting tool in accordance with one embodiment.

Referring to FIG. 1, a cutting tool is generally shown at 10. The cutting tool 10 is rotatable about an axis A and has a plurality of knife holders 12 along its periphery. The knife holders 12 are configured for receiving knife inserts 14 that are used for machining either one of tongues and grooves in hardwood planks. It is however understood that the features described herein are not limited for cutting tools used for machining tongues and grooves and may be used in any rotating tools. The knife inserts 14 may consist of diamond and/or carbide profiled inserts or other similar wear resistant material inserts offering long working life and high quality surface finish.

The cutting tool 10 is configured for slidably receiving a shaft 16 (FIG. 3) of a machine therein. The cutting tool 10 has axial end annular walls 18 that surrounds a central aperture. The machine is configured for rotating the shaft 16 and the cutting tool 10 secured thereto. A securing mean, which, in the embodiment shown, is a hydraulic sleeve H (FIG. 2), is used to secure the cutting tool 10 to the shaft 16 such that the cutting tool 10 rotates integrally at unison with the shaft 16 about the axis A.

The securing mean might help in correcting at least partially the radial run-out. However, when the radial run-out varies along the length of the shaft 16, a lateral run-out remains. The lateral run-out causes waves in the grooves along the length of the planks.

If the knife inserts 14 are made of steel or other similar materials, the lateral run-out is corrected by grinding the knife inserts 14 with a stone model. The stone model is made of a material harder than a material of the knife inserts 14 and has a shape corresponding to that of either the tongue or the groove. The cutting tool 10 is rotated and the stone model is slowly brought in proximity to the knife inserts 14. Portions of knife inserts 14 that are outside manufacturing tolerances will be grinded away by the stone.

However, this solution prevents using harder materials for the knife inserts 14 because such materials are too hard to be grinded by the stone. Indeed, if the knife inserts 14 are made of carbide and/or diamond—which is desirable to decrease the sharpening frequency and to increase productivity—it is not possible to correct the lateral run-out in this way because the stone model is not sufficiently hard relative to the knife inserts 14. In other words, the knife inserts 14, when made of carbide and/or diamonds, might be too hard to be corrected by the stone model. Therefore, another way of catering to the lateral run-out might be required.

In the depicted embodiment, the knife holders 12 and knife inserts 14 include a lower series of knife holders 12*a* and inserts 14*a* and an upper series of knife holders 12*b* and inserts 14*b*, each being located proximate to a respective one of the axial end annular walls 18. Cooperation of the lower and upper series of the knife inserts 14*a*, 14*b* define the shape of either the tongue or the groove.

Figure 2:
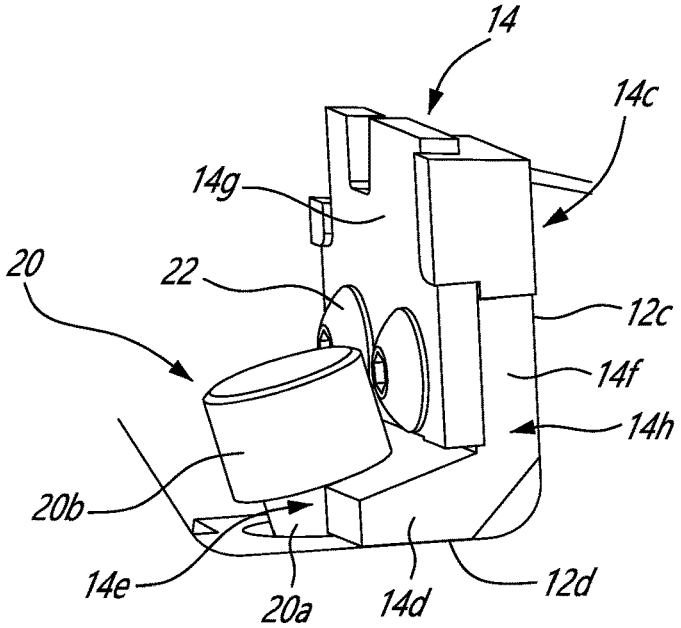
FIG. 2 is a schematic tridimensional view of a knife insert secured to a knife holder of the cutting tool of FIG. 1.
Figure 3:
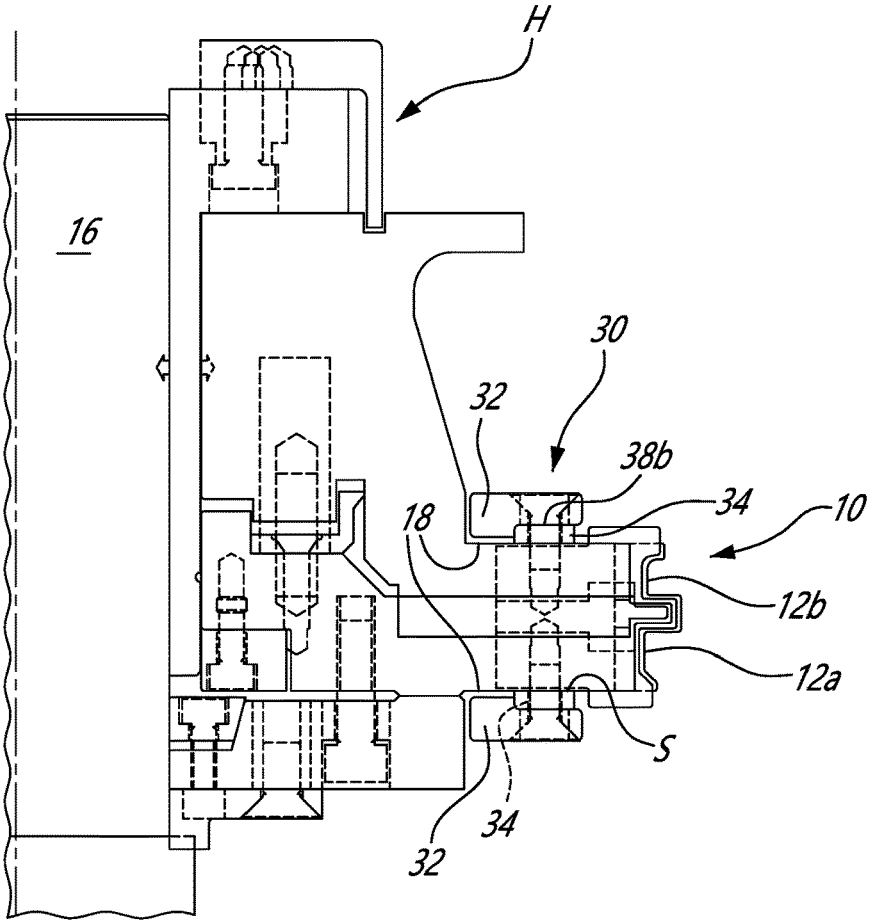
FIG. 3 is a schematic partial cross-sectional view of the cutting tool of FIG. 1.
Figure 4:
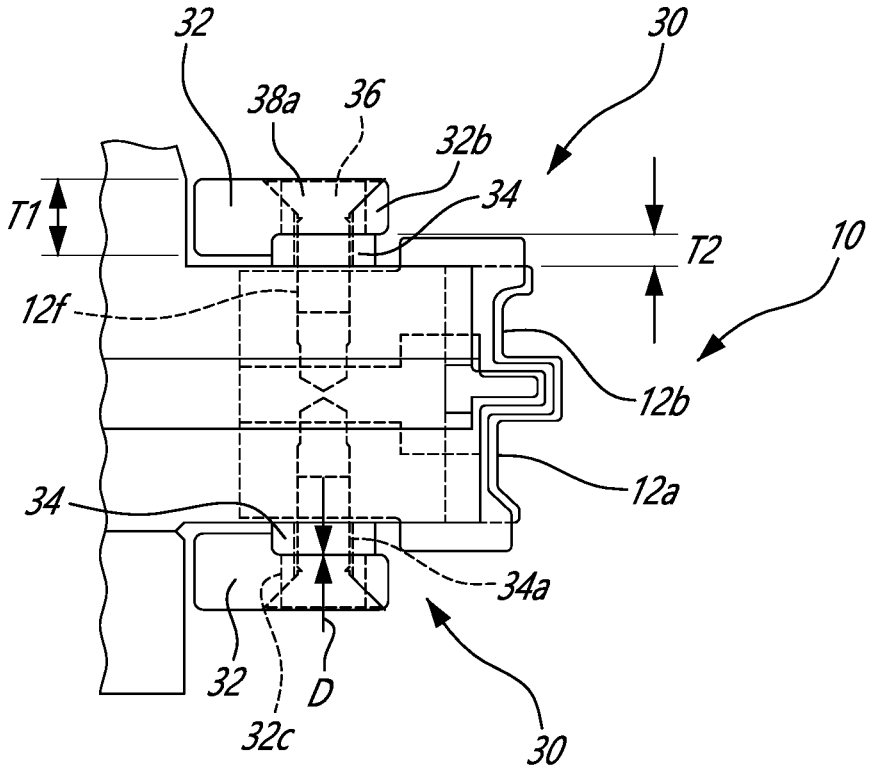
FIG. 4 is an enlarged view of a portion of the cross-sectional view of FIG. 3.

Referring now to FIGS. 1-2, the knife holders 12 each have an L-shape and include back surfaces 12*c* and seat surfaces 12*d*. The back surfaces 12*c* are facing a circumferential direction T relative to the axis A and the seat surfaces 12*d* are facing a radial direction R relative to the axis A. The knife holders 12 limit movements of the knife inserts 14 in the radial and circumferential directions R, T. More specifically, movements of the knife inserts 14 in the circumferential direction T, in a clock-wise orientation (shown by the arrow T), are limited by the back surfaces 12*c* and movements of the knife inserts 14 in the radial direction R toward the axis A are limited by the seat surfaces 12*d*. The knife holders 12 further include threaded apertures 12*e* extending substantially in the radial direction R from the seat surfaces 12 *d* toward the axis A. The threaded apertures 12*e* are configured to threadingly receive friction fasteners 20 used for securing the knife inserts 14 to the cutting tool 10 via the knife holders 12.

Referring more particularly to FIG. 2, the knife inserts 14 have an L-shape with upper sections 14*c* configured to be in abutment with the knife holder back surfaces 12*c* and lower sections 14*d* configured to be in abutment with the knife holder seat surfaces 12*d*. The knife inserts 14 each have a semi-circular groove 14*e*. Movements of the knife inserts 14 in the circumferential direction T and in a counter-clockwise orientation (opposite to the direction depicted by arrow T on FIG. 1) and movements of the knife inserts 14 in the radial direction R away from the axis A are limited by the friction fasteners 20 that are threadingly engageable within the threaded apertures 12*e* located at the seat surfaces 12*d*. More specifically, each of the friction fasteners 20 has a body 20*a* and a head 20*b*. The body 20*a* is slidingly received within the semi-circular groove 14*e* of a respective one of the knife inserts 14 and the head 20*b* is configured to be in abutment against the lower section 14*d* of the respective one of the knife inserts 14. Hence, the friction fastener bodies 20*a* limit movements of the knife inserts 14 in the counter-clockwise orientation whereas the fastener heads 20*b* limit movements of the knife inserts 14 in the radial direction R away from the axis A.

In the depicted embodiment, each of the knife inserts 14 has a member 14*f* that has the L-shape described herein above and a knife 14*g* secured to the member 14*f* via fasteners 22. In a particular embodiment, when the knives 14*g* become blunt, the knife inserts 14 may be removed and the knives 14*g* may be removed from the member 14*f* to be either sharpen or replaced.

Referring to FIGS. 1-4, movements of the knife inserts 14 in an axial direction A1 relative to the axis A are preferably limited. In the embodiment shown, an adjusting mechanism 30 is used to create an adjustable lateral reference surface S. The adjustable lateral reference surface S is configured to be in abutment with lateral sides 14*h* of the knife inserts 14 and to limit movements of the knife inserts 14 in the axial direction A1 toward the adjusting mechanism 30 and configured to adjust an axial position of the knife inserts 14 relative to the axis A to cater to the lateral run-out.

An adjusting mechanism 30 is provided for each of the upper and lower series of the knife holders 12*a*, 12*b* and knife inserts 14*a*, 14*b*. Therefore, for the upper series, the adjusting mechanism 30 limits movements of the knife inserts 14*b* in the axial direction A1 away from the lower series 14*a* and vice-versa for the adjusting mechanism 30 of the lower series 14*a*. Both of the adjusting mechanisms 30 shown in FIG. 1 may be identical and, therefore, only the lower one of them is described herein below.

The adjusting mechanism 30 includes a support member 32 spanning at least two of the knife holders 12. The support member 32 has fixation points 32*a* for securement to the cutting tool 10. In the depicted embodiment, the support member 32 is a one-piece support ring 32' that circumferentially and continuously extends all around the axis A and that spans all of the knife holders 12.

The adjusting mechanism 30 further includes a deformable member 34 sandwiched axially between the cutting tool 10 and the support member 32, more specifically between the knife holders 12 and the support member 32. The deformable member 34 defines the adjustable lateral reference surface S that faces the axial direction A1 relative to the axis A and that is in abutment with the lateral surfaces 14 *h* (FIG. 2) of the knife inserts 14 of the cutting tool 10. In the depicted embodiment, the deformable member 34 is a one-piece deformable ring 34' that circumferentially and continuously extends all around the axis A and that spans all of the knife holders 12.

The deformable member 34 and the support member 32 may be made of the same material. Therefore, to ensure that it is the deformable member 34 that deforms, a thickness T1 of the support member 32 taken in the axial direction A1 relative to the axis A is greater than a thickness T2 of the deformable member 34. It is understood that the thicknesses T1, T2 of the support member 32 and of the deformable member 34 may be equivalent if, for instance, the deformable member 34 is made of a material that is less stiff than the material the support member 32 is made of. Other configurations are contemplated without departing from the scope of the present disclosure.

In the depicted embodiment, a number of the fixation points 32*a* of the support member 32 corresponds to a number of the knife holders 12 of the lower series 12*a* of the knife holders 12 of the cutting tool 10. As shown more clearly on FIGS. 1 and 4, each of the fixation points 32*a* is an aperture 32*b* extending through the support member 32 and registering with a threaded aperture 12*f* extending in the axial direction A1 through the knife holders 12 and within an aperture 34*a* extending through the deformable member 34. Fasteners 36 are threadingly engaged within the threaded apertures 12*f* of the knife holders 12 for securing the support member 32, and the deformable member 34, to the cutting tool 10 via the knife holders 12. The fasteners 36 are slidably received within the apertures 34*a* of the deformable member 34.

The adjusting mechanism 30 further includes an adjustment member 38 mounted on one of the support member 32 and the deformable member 34 at a location between two adjacent ones of the fixation points 32*a* of the support member 32. The adjustment member 38 is operable to exert a force on the deformable member 34 to locally deform the deformable member 34 from an undeformed state to a deformed state. An axial distance D (FIG. 4) between the support member 32 and the deformable member 34 at the location is greater in the deformed state than in the undeformed state. An axial position of the adjustable lateral reference surface S at the location varies from the undeformed state to the deformed state.

In the depicted embodiment, a plurality of adjustment members 38 are used, each located between two adjacent ones of the fixation points 32*a*. As shown, the location circumferentially registers with the lateral surface 14*h* of a respective one of the knife inserts 14 when in abutment against the back and seat surfaces 12*c*, 12*d* of the knife holders 12.

In the embodiment shown, each of the adjustment members 38 is an adjustment fastener 38*a* threadingly engaged within a respective one of threaded apertures 32*c* extending through the support member 32. A tip 38*b* (FIG. 3) of each of the adjustment fasteners 38*a* is in abutment against the deformable member 34. Alternatively, the adjustment fasteners 38*a* may be threadingly engaged in a threaded aperture extending through the deformable member 34 and having its tip 38*b* in abutment against the support member 32.

Figure 5A:
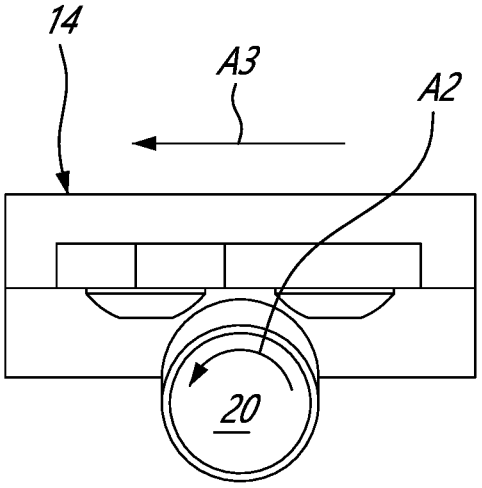
FIGS. 5A and 5B are schematic top views illustrating friction fasteners securing the knife inserts to the knife holders of the cutting tool of FIG. 1.
Figure 5B:
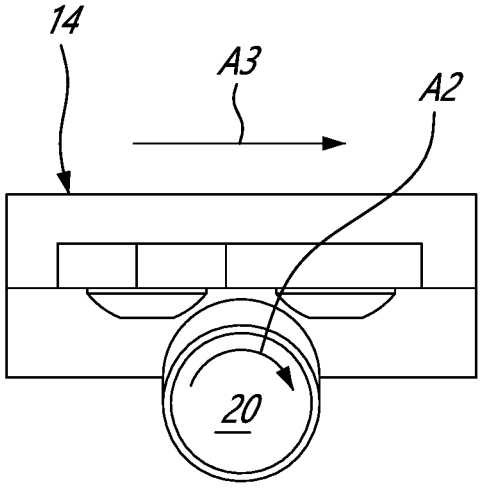

Referring now to FIGS. 1-2 and 5A-5B, the friction fasteners 20 that are threadingly engaged within the correspondingly threaded apertures 12*e* extending from the seat surface 12*d* toward the axis A are configured to frictionally displace the knife inserts 14 in abutment against the deformable member 34. More specifically, the friction fasteners heads 20*a* are in abutment against the knife inserts 14 as depicted in FIG. 2. As seen in FIGS. 5A and 5B, rotation of the friction fasteners 20 along direction depicted by arrows A2 from a first position to a second position displace, by friction, the knife inserts 14 along direction depicted by arrow A3 until they are in abutment against the deformable member 34. The friction fasteners 20 have right-handed threads for the lower series of the knife holders 12*a* and inserts 14*a* and have left-handed threads for the upper series of knife holders 12*b* and inserts 14*b*.

Referring to all figures, for adjusting the knife inserts 14 on the cutting tool 10 the knife inserts 14 are abutted against back surfaces 12*c* and seat surfaces 12*d* of knife holders 12 of the cutting tool 10. The knife inserts 14 are abutted against the adjustable lateral reference surface S of the deformable member 34 of the adjusting mechanism 30. The deformable member 34 is deformed at least at a location between fixation points 32*a* of the support member 32.

In the depicted embodiment, abutting the knife inserts lateral surfaces 14*h* against the adjustable lateral reference surface S includes frictionally dragging the knife inserts 14 along the axial direction A1 and along the seat surfaces 12*d* toward the deformable member 34.

As illustrated, frictionally dragging the knife inserts 14 includes rotating the friction fasteners 20 until heads 20*b* of the friction fasteners 20 become in engagement with the knife inserts 14 and further rotating the friction fastener 20 to create friction between the heads 20*b* and the knife inserts 14 to move the knife inserts 14 toward the deformable member 34.

In the embodiment shown, deforming the deformable member 34 includes rotating the adjusting fastener 38*a* within the correspondingly threaded aperture 32*c* of the support member 32 and pushing the deformable member 34, at the location, away from the support member 32 with the fastener having its tip 38*b* in abutment against the deformable member 34.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. An adjusting mechanism for a cutting tool rotatable about an axis, the cutting tool having knife holders circumferentially interspaced around a circumference thereof, the knife holders having a back surface facing a circumferential direction relative to the axis and a seat surface facing a radial direction relative to the axis, knife inserts supported by the back surface and by the seat surface of the knife holders the adjusting mechanism comprising:

a support member configured for circumferentially spanning at least two of the knife holders, the support member having fixation points securable to the cutting tool;

a deformable member configured for being sandwiched axially between the cutting tool and the support member, the deformable member defining an adjustable lateral reference surface facing an axial direction relative to the axis and configured to be in abutment with the knife inserts of the cutting tool; and an adjustment member mounted on one of the support member and the deformable member at a location between the fixation points of the support member, the adjustment member being operable to exert a force on the deformable member to locally deform the deformable member from an undeformed state to a deformed state, an axial distance between the support member and the deformable member at the location being greater in the deformed state than in the undeformed state, an axial position of the adjustable lateral reference surface at the location varying from the undeformed state to the deformed state, wherein the deformable member is a deformable ring circumferentially and continuously extending around the axis.

2. The adjusting mechanism of claim 1, wherein the location circumferentially registers with a respective one of the knife inserts.

3. The adjusting mechanism of claim 1, wherein the support member is a support ring circumferentially and continuously extending around the axis.

4. The adjusting mechanism of claim 1, wherein a number of the fixation points corresponds to a number of the knife holders of the cutting tool.

5. The adjusting mechanism of claim 1, wherein the adjustment member is an adjustment fastener threadingly engaged within a threaded aperture extending through the support member, a tip of the fastener being in abutment against the deformable member.

6. The adjustment mechanism of claim 1, including a plurality of adjustment members, each of the plurality of adjustment members being located between two adjacent ones of the fixation points.

7. The adjustment mechanism of claim 1, further including friction fasteners threadingly engageable within correspondingly threaded apertures extending from the seat surface toward the axis, the friction fasteners having heads for abutment against the knife inserts, rotation of the friction fasteners from a first position to a second position configured to frictionally displace the knife inserts in abutment against the deformable member.

8. A cutting tool rotatable about and axis, the cutting tool comprising:

knife holders circumferentially interspaced around a circumference thereof, the knife holders having back surfaces facing a circumferential direction relative to the axis and seat surface facing a radial direction relative to the axis, the back surfaces and the seat surfaces configured to be in abutment against knife inserts;

an adjusting mechanism including a support member circumferentially spanning at least two of the knife holders and secured to the knife holders at fixation points, a deformable member sandwiched between the cutting tool and the support member, the deformable member defining an adjustable lateral reference surface facing an axial direction relative to the axis and being in abutment with the knife inserts, an adjustment member mounted on one of the support member and the deformable member at a location between the fixation points of the support member, the adjustment member being operable to exert a force on the deformable member to locally deform the deformable member from an undeformed state to a deformed state, an axial distance between the support member and the deformable member at the location being greater in the deformed state than in the undeformed state, an axial position of the adjustable lateral reference surface at the location varying from the undeformed state to the deformed state, wherein the deformable member is a deformable ring circumferentially and continuously extending around the axis.

9. The cutting tool of claim 8, wherein the location circumferentially registers with a respective one of the knife inserts.

10. The cutting tool of claim 8, wherein the support member is a support ring circumferentially and continuously extending around the axis.

11. The cutting tool of claim 8, wherein a number of the fixation points corresponds to a number of the knife holders of the cutting tool.

12. The cutting tool of claim 8, wherein the adjustment member is an adjustment fastener threadingly engaged within a threaded aperture extending through the support member, a tip of the fastener being in abutment against the deformable member.

13. The cutting tool of claim 8, including a plurality of adjustment members, each of the plurality of adjustment members being located between two adjacent ones of the fixation points.

14. The cutting tool of claim 8, further including fasteners threadingly engageable within correspondingly threaded apertures extending from the seat surface toward the axis, the fasteners having heads for abutment against the knife inserts, rotation of the fasteners from a first position to a second position configured to frictionally displace the knife inserts in abutment against the deformable member.

* * * * *